US011473224B1

(12) United States Patent
Odum et al.

(10) Patent No.: US 11,473,224 B1
(45) Date of Patent: Oct. 18, 2022

(54) FIRE RESISTANT FABRIC AND PROCESS TO PRODUCE SAME

(71) Applicant: Denim North America, Columbus, GA (US)

(72) Inventors: Marty Edward Odum, Hamilton, GA (US); Linsey H. Flitcroft, Salem, AL (US)

(73) Assignee: DENIM NORTH AMERICA, Columbus, GA (US)

( * ) Notice: Subject to any disclaimer, the term of this patent is extended or adjusted under 35 U.S.C. 154(b) by 109 days.

(21) Appl. No.: 16/856,549

(22) Filed: Apr. 23, 2020

Related U.S. Application Data

(60) Provisional application No. 62/837,355, filed on Apr. 23, 2019.

(51) Int. Cl.
*D03D 15/513* (2021.01)
*D03D 1/00* (2006.01)

(52) U.S. Cl.
CPC ..... *D03D 15/513* (2021.01); *D03D 1/00* (2013.01); *D10B 2201/02* (2013.01); *D10B 2321/101* (2013.01); *D10B 2331/02* (2013.01); *D10B 2401/061* (2013.01); *D10B 2501/06* (2013.01)

(58) Field of Classification Search
None
See application file for complete search history.

(56) References Cited

U.S. PATENT DOCUMENTS 3,193,602 A 7/1965 Leonard et al.
3,748,302 A 7/1973 Jones
3,803,453 A 4/1974 Hull
4,035,441 A 7/1977 Endo et al.
4,107,129 A 8/1978 Tanaka et al.
5,208,105 A 5/1993 Ichibori et al.
5,506,042 A 4/1996 Ichibori et al.
9,034,777 B2 * 5/2015 Hines ..... A41D 1/02 442/209
9,745,674 B2 8/2017 Hines et al.
9,988,758 B2 6/2018 Minor et al.
10,119,207 B2 11/2018 Casanova Royo
2013/0189518 A1 7/2013 Li et al.
2018/0245251 A1 8/2018 Dash et al.
2019/0106816 A1 4/2019 Beagle et al.

OTHER PUBLICATIONS

Kandola, B.K. "Natural Fibre-Reinforced Thermoplastic Composites from Woven-Nonwoven Textile Preforms: Mechanical and Fire Performance Study", Composites Part B (2018), pp. 456-464.
Feng, Jie et al. "Study of a Newly Structuralized Meta-aramid/cotton Blended Yarn for Fabrics With Enhanced Flame-Resistance",Textile Research (2019), vol. 90(5-6), pp. 489-502.
Shamsuyeva, Madina et al. "Manufacture of Hybrid Natural/Synthetic Fiber Woven Textiles for Use In Technical Biocomposites with Maximum Biobased Content", J Composites Science (2019), 3, 43, 1-17.

* cited by examiner

*Primary Examiner* — Arti Singh-Pandey
(74) *Attorney, Agent, or Firm* — Ballard Spahr LLP

(57) ABSTRACT

Fabrics and garments are disclosed that exhibit fire resistance. The fabric has yarn containing FR materials that provide for the fire resistance. The fabric is optionally dyed. This abstract is intended as a scanning tool for purposes of searching in the particular art and is not intended to be limiting of the present invention.

20 Claims, 1 Drawing Sheet

FIRE RESISTANT FABRIC AND PROCESS TO PRODUCE SAME

CROSS-REFERENCE TO RELATED APPLICATIONS

This application claims the benefit of U.S. Provisional Application No. 62/837,355, filed Apr. 23, 2019, which is hereby incorporated by reference in its entirety.

FIELD OF THE INVENTION

The invention relates to a fabric and garments having fire resistant properties, and processes to produce said fabrics and garments.

BACKGROUND OF THE INVENTION

Fire resistant (FR) fabrics are produced in a number of ways. Some manufacturers utilize fire resistant yarns such as modacrylic, aramid, and the like. These fire resistant fabrics can be stiff and uncomfortable and have limited dye acceptance. Another approach is to utilize natural yarns such as cotton and treat the yarn and/or fabric with a flame retardant finish. The flame retardant finish creates a harsh fabric hand, is not permanent and contains potentially carcinogenic chemicals. There exists a need for a dyed fabric that is comfortable to wear, is durable to washing, especially premium washing, contains no potentially carcinogenic chemicals, and meets the required FR fabric compliance testing, such as NFPA 2112.

Such a fabric and garments are disclosed herein. Also, disclosed are related methods.

SUMMARY OF THE INVENTION

The invention relates generally to a fabric that is optionally dyed and garments that exhibit fire resistance. Fire resistance is an intrinsic part of inherently flame resistant fibers and is a permanent attribute of the fabric. The fire resistance cannot be washed out or worn out of the fibers, regardless of how the garment is used or laundered, under normal conditions.

Disclosed herein is a fabric comprising: a) plurality of warp yarns comprising from about more than 95% to about 99.75% by weight of at least one natural fiber and from about 0.25% to less than about 5% by weight of aramid, nylon, FR rayon, polybenzimidazole, or oxidized polyacrylonitrile, or a combination thereof; wherein the plurality of warp yarns comprises: i) at least one natural warp yarn consisting essentially of natural fibers; an ii) at least one FR warp yarn comprising FR fibers selected from aramid, nylon, FR rayon, polybenzimidazole, or oxidized polyacrylonitrile, or a combination thereof; b) a plurality of weft yarns comprising at least one modacrylic weft yarn comprising from about 0% to 35% by weight of natural fiber and 100% to 65% by weight of modacrylic fibers; wherein the fabric meets the requirements for flame resistance, as set forth in National Fire Protection Association 2112; and wherein the fabric has a basis weight from about 6 oz/yd$^2$ to about 14 oz/yd$^2$.

Also disclosed herein is a fabric comprising: a) a plurality of warp yarns comprising: i) at least one natural warp yarn consisting essentially of natural fibers; and ii) at least one FR warp yarn comprising FR fibers selected from aramid, nylon, FR rayon, polybenzimidazole, or oxidized polyacrylonitrile, or a combination thereof; wherein the plurality of warp yarns comprises a pattern defined by an arrangement of the at least one natural warp yarn and the at least one FR warp yarn, wherein each FR warp yarn is substantially evenly distributed throughout the plurality of warp yarns, and b) a plurality of weft yarns comprising at least one modacrylic weft yarn comprising from about 0% to 35% by weight of natural fiber and 100% to 65% by weight of modacrylic fibers; wherein the fabric meets the requirements for flame resistance, as set forth in National Fire Protection Association 2112; and wherein the fabric has a basis weight from about 6 oz/yd$^2$ to about 14 oz/yd$^2$.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE FIGURES

These and other features of the preferred embodiments of the invention will become more apparent in the detailed description in which reference is made to the appended drawings wherein.

DETAILED DESCRIPTION

Figure 1:
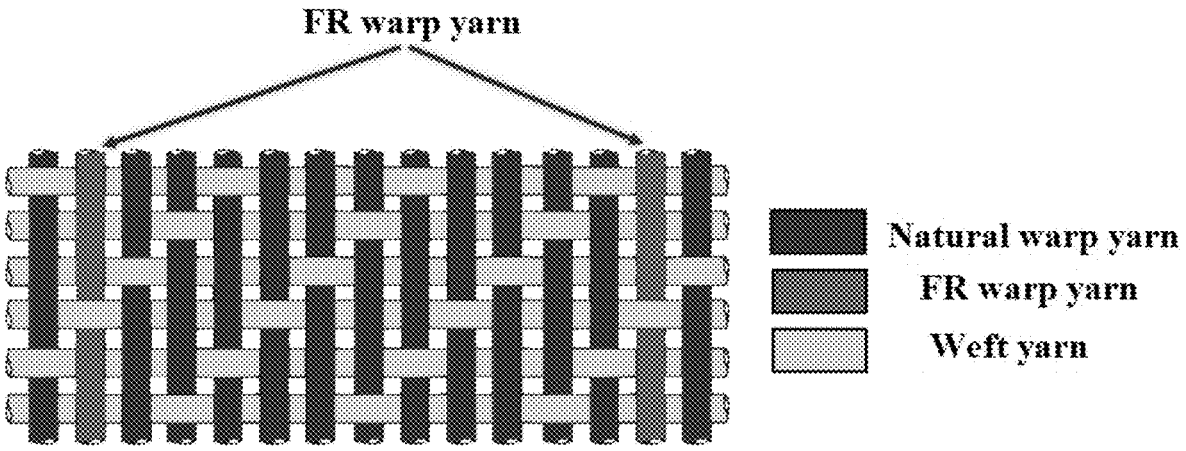
FIG. 1 shows a non-limiting exemplary fabric disclosed herein.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

It is also to be understood that the terminology used herein is for the purpose of describing particular aspects only and is not intended to be limiting. Although any devices and methods similar or equivalent to those described herein can be used in the practice or testing of the present invention, example methods and materials are now described.

As used in the specification and in the claims, the term "comprising" can include the aspects "consisting of" and "consisting essentially of" Unless defined otherwise, all technical and scientific terms used herein have the same meaning as commonly understood by one of ordinary skill in the art to which this invention belongs. In this specification and in the claims, which follow, reference will be made to a number of terms which shall be defined herein.

As used in the specification and the appended claims, the singular forms "a," "an," and "the" include plural referents unless the context clearly dictates otherwise. Thus, for example, reference to "a subject" includes two or more subjects.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the term "modacrylic" refers to an acrylic synthetic fiber made from a polymer comprising primarily residues of acrylonitrile. Modacrylic fibers are spun from an extensive range of copolymers of acrylonitrile. The modacrylic fiber may contain the residues of other monomers, including vinyl monomer, especially halogen-containing vinyl monomers, such as but not limited to vinyl chloride, vinylidene chloride, vinyl bromide, vinylidene bromide, and the like. The types of modacrylic fibers that can be produced within this broad category are capable of wide variation in properties, depending on their composition. Some examples of commonly available modacrylics are PROTEX™, KANEKALON™, and KANECARON™ by Kaneka Corporation, PYROTEX™, and Formosa Plastics.

The choice of modacrylic fibers or yarns for application in the fabric disclosed herein can be based on their excellent fire retardancy performance combined with their non-melt, non-drip and self-extinguishing properties. These are critically important attributes in many working environments. If sufficiently high temperatures are reached on exposure to fire or explosion, a garment made with the inventive fabric will just carbonize by forming a protective char barrier. This prevents propagation of flames, thereby protecting the wearer from severe burn injuries. Modacrylic fibers for use in yarns disclosed herein can be copolymers of acrylonitrile combined with vinylidene chloride, the copolymer having in addition an antimony oxide or antimony oxides for improved fire retardancy. Such useful modacrylic fibers include, but are not limited to, fibers disclosed U.S. Pat. No. 3,193,602 having 2 weight percent antimony trioxide, fibers disclosed in U.S. Pat. No. 3,748,302 made with various antimony oxides that are present in an amount of at least 2 weight percent and preferably not greater than 8 weight percent, and fibers disclosed in U.S. Pat. Nos. 5,208,105 and 5,506,042 having 8 to 40 weight percent of an antimony compound. As discussed above, a modacrylic fiber is available commercially under the trademark of PROTEX C from Kaneka America Corporation, New York, N.Y. PROTEX C fiber is a fiber made from a copolymer of polyacrylonitrile and vinylidene chloride with 5 to 15% antimony having a linear density of 1.7 dtex/filament (1.5 denier/filament) and a cut length of 5.1 cm (2 in), although fibers having less antimony oxide, in the range of less than 5 weight percent can also be used.

As used herein, the term "aramid" refers to a manufactured fiber in which the fiber-forming substance is a long-chain synthetic polyamide in which at least 85% of the amide linkages, (—CO—NH—), are attached directly to two aromatic rings. Aramid fibers can be bought from a number of commercial sources, including Teijan.

As used herein, the term "nylon" includes all forms of nylon, such as nylon 66. Nylon can be bought from a number of commercial sources, including DuPont.

As used herein, the term "antistatic fiber" refers to a fiber, when incorporated into a fabric or other material, eliminates or reduces static electricity. Suitable fibers include, but are not limited to, metal fibers (steel, copper or other metal), metal-plated polymeric fibers, and polymeric fibers incorporating carbon black on the surface and/or in the interior of the fiber, such as those described in U.S. Pat. Nos. 3,803,453, 4,035,441, 4,107,129, and the like. Antistatic carbon fiber is a preferred antistatic fiber. One example of such conductive fiber is NEGASTAT® produced by E.I. du Pont de Nemours and Company, a carbon fiber comprising a carbon core of conductive carbon surrounded by non-conductive polymer cover, either nylon or polyester. Another example is RESISTAT® made Shakespeare Conductive Fibers LLC, a fiber where the fine carbon particles are embossed on the surface of a nylon filament. The yarns of both such fibers are available in a denier of at least 40. By way of example, a steel wire is available under the names BEKINOX and BEKITEX from Bekaert S. A. in a diameter as small as 0.035 millimeter. Another antistatic fiber is the product X-static made by Noble Fiber Technologies, a nylon fiber coated with a metal (silver) layer. The X-static fibers may be blended with other fibers, such as modacrylics, in the process of yarn spinning.

As used herein, the term "by weight" refers to a measure of the weight of a fabric per unit area. Typical units include ounces per square yard and grams per square meter.

As used herein, the term "garment" refers to any article of clothing or clothing accessory worn by a person, including, but not limited to shirt, pants, underwear, outer wear, footwear, headwear, swimwear, belts, gloves, headbands, and wristbands, especially those used as protective wear or gear. The fabric disclosed herein can be used to make the garments disclosed herein.

As used herein, the term "intimate blend," when used in conjunction with a yarn, refers to a statistically random mixture of the staple fiber components in the yarn.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Because of its durability and comfort, denim fabrics are often used in work clothing, including pants, overalls, jumpsuits, and jackets. Conventional FR denim products achieve their fire protection from fire resistant treatments. The terms "treated" or "topically treated" refer to a manufacturing step where a special mixture of chemicals is added to non-FR fabric, such as cotton or cotton/nylon blends, to make the final fabric fire resistant. The chemical mixture used in this "treatment" produces potentially carcinogenic byproducts (ex. Formaldehyde). While fabrics made with inherently FR fibers retain their FR protection throughout the life of the garment, chemically treated FR fabrics may have their flame-resistant properties reduced or removed completely depending on how, and how many times these fabrics are laundered. Likewise, exposure to certain chemicals in the work environment may also diminish or eliminate the fabric's FR properties. Sometimes, the treatments/additives adversely impact the comfort such as breathability and hand feel. Fiber selection to achieve fire resistance in inherently flame-resistant fabrics often negatively impacts the ability to dye the fabric, especially so that it has a traditional denim look and feel. The inherent fibers are also expensive to the point that inherent fire resistant fabrics that qualify as "dual hazard" certified are often not affordable in the market.

Disclosed herein is a fabric comprising:

a) a plurality of warp yarns comprising from about more than 95% to about 99.75% by weight of at least one natural fiber and from about 0.25% to less than about 5% by weight of aramid, nylon, FR rayon, polybenzimidazole, or oxidized polyacrylonitrile, or a combination thereof; wherein the plurality of warp yarns comprises:
   i) at least one natural warp yarn consisting essentially of natural fibers; and
   ii) at least one FR warp yarn comprising FR fibers selected from aramid, nylon, FR rayon, polybenzimidazole, or oxidized polyacrylonitrile, or a combination thereof;

b) a plurality of weft yarns comprising at least one modacrylic weft yarn comprising from about 0% to 35% by weight of natural fiber and 100% to 65% by weight of modacrylic fibers;

wherein the fabric meets the requirements for flame resistance, as set forth in National Fire Protection Association 2112; and wherein the fabric has a basis weight from about 6 oz/yd$^2$ to about 14 oz/yd$^2$.

Also disclosed herein is a fabric comprising:

a) a plurality of warp yarns comprising:
   i) at least one natural warp yarn consisting essentially of natural fibers; and
   ii) at least one FR warp yarn comprising FR fibers selected from aramid, nylon, FR rayon, polybenzimidazole, or oxidized polyacrylonitrile, or a combination thereof;

wherein the plurality of warp yarns comprises a pattern defined by an arrangement of the at least one natural warp yarn and the at least one FR warp yarn, wherein each FR warp yarn is substantially evenly distributed throughout the plurality of warp yarns, and b) a plurality of weft yarns comprising at least one modacrylic weft yarn comprising from about 0% to 35% by weight of natural fiber and 100% to 65% by weight of modacrylic fibers;

wherein the fabric meets the requirements for flame resistance, as set forth in National Fire Protection Association 2112; and wherein the fabric has a basis weight from about 6 oz/yd$^2$ to about 14 oz/yd$^2$.

In one aspect, the fabric can be in the form of a garment. Suitable garments include, but are not limited to, a jacket, a pair of pants, shorts, or a shirt. For example, the garment can be a pair of pants or a jacket.

In one aspect, the fabric can be denim.

In one aspect, the plurality of warp yarns can comprise from about 95.5% to about 99.75% by weight of at least one natural fiber and from about 0.25% to about 4.5% by weight of aramid, nylon, FR rayon, polybenzimidazole, or oxidized polyacrylonitrile, or a combination thereof. For example, the plurality of warp yarns can comprise from about 96.0% to about 99.75% by weight of at least one natural fiber and from about 0.25% to about 4.0% by weight of aramid, nylon, FR rayon, polybenzimidazole, or oxidized polyacrylonitrile, or a combination thereof. IN yet another example, the plurality of warp yarns can comprise from about 96.5% to about 99.75% by weight of at least one natural fiber and from about 0.25% to about 3.5% by weight of aramid, nylon, FR rayon, polybenzimidazole, or oxidized polyacrylonitrile, or a combination thereof. In yet another example, the plurality of warp yarns can comprise from about 97.0% to about 99.75% by weight of at least one natural fiber and from about 0.25% to about 3.0% by weight of aramid, nylon, FR rayon, polybenzimidazole, or oxidized polyacrylonitrile, or a combination thereof. In yet another example, the plurality of warp yarns can comprise from about 98.0% to about 99.75% by weight of at least one natural fiber and from about 0.25% to about 2.0% by weight of aramid, nylon, FR rayon, polybenzimidazole, or oxidized polyacrylonitrile, or a combination thereof. In yet another example, the plurality of warp yarns can comprise from about 95.5% to about 98.0% by weight of at least one natural fiber and from about 2.0% to about 4.5% by weight of aramid, nylon, FR rayon, polybenzimidazole, or oxidized polyacrylonitrile, or a combination thereof.

In one aspect, the FR warp yarn comprises a mixture of natural fibers and the FR fibers selected from aramid, nylon, FR rayon, polybenzimidazole, or oxidized polyacrylonitrile, or a combination thereof. For example, the FR warp yarn can comprise a mixture of natural fibers and FR fibers of aramid. In another example, the FR warp yarn can comprise a mixture of natural fibers and FR fibers of nylon. In yet another example, the FR warp yarn can comprise a mixture of natural fibers and FR fibers of FR rayon. In yet another example, the FR warp yarn can comprise a mixture of natural fibers and FR fibers of polybenzimidazole. In yet another example, the FR warp yarn can comprise a mixture of natural fibers and FR fibers of oxidized polyacrylonitrile.

In one aspect, the FR warp yarn comprises a mixture of a natural fibers and the FR fibers selected from aramid, nylon, FR rayon, polybenzimidazole, or oxidized polyacrylonitrile, or a combination thereof, wherein the natural fibers are present in an amount from 25% by weight to 95% by weight, and wherein the FR fibers are present in an amount from 75% by weight to 5% by weight of the FR warp yarn. For example, the FR warp yarn can comprise a mixture of a natural fibers and the FR fibers selected from aramid, nylon, FR rayon, polybenzimidazole, or oxidized polyacrylonitrile, or a combination thereof, wherein the natural fibers are present in an amount from 40% by weight to 95% by weight, and wherein the FR fibers are present in an amount from 60% by weight to 5% by weight of the FR warp yarn. In another example, the FR warp yarn comprises a mixture of a natural fibers and the FR fibers selected from aramid, nylon, FR rayon, polybenzimidazole, or oxidized polyacrylonitrile, or a combination thereof, wherein the natural fibers are present in an amount from 60% by weight to 95% by weight, and wherein the FR fibers are present in an amount from 40% by weight to 5% by weight of the FR warp yarn. In yet another example, the FR warp yarn comprises a mixture of a natural fibers and the FR fibers selected from aramid, nylon, FR rayon, polybenzimidazole, or oxidized polyacrylonitrile, or a combination thereof, wherein the natural fibers are present in an amount from 85% by weight to 95% by weight, and wherein the FR fibers are present in an amount from 15% by weight to 5% by weight of the FR warp yarn.

In one aspect, the plurality of warp yarns further comprises at least one modacrylic warp yarn.

In one aspect, the weft yarn can comprise of 100% by weight of modacrylic fibers. In another aspect, the weft yarn can comprise about 20% to 30% by weight of natural fiber and 80% to 70% by weight of modacrylic fibers.

In one aspect, the weft yarn comprises at least one FR weft yarn comprising FR fibers selected from aramid, nylon, FR rayon, polybenzimidazole, or oxidized polyacrylonitrile, or a combination thereof, wherein the weft yarn comprises from more than 0% by weight to about 4.5% by weight aramid, nylon, FR rayon, polybenzimidazole, or oxidized polyacrylonitrile, or a combination, wherein the fabric does not have more than about 5% by weight of aramid, nylon, FR rayon, polybenzimidazole, or oxidized polyacrylonitrile, or a combination thereof. For example, the weft yarn can comprise comprises at least one FR weft yarn comprising FR fibers selected from aramid, nylon, FR rayon, polybenzimidazole, or oxidized polyacrylonitrile, or a combination thereof, wherein the weft yarn comprises from more than 0% by weight to about 3.5% by weight aramid, nylon, FR rayon, polybenzimidazole, or oxidized polyacrylonitrile, or a combination, wherein the fabric does not have more than about 5% by weight of aramid, nylon, FR rayon, polybenzimidazole, or oxidized polyacrylonitrile, or a combination thereof. In yet another example, the weft yarn can comprise comprises at least one FR weft yarn comprising FR fibers selected from aramid, nylon, FR rayon, polybenzimidazole, or oxidized polyacrylonitrile, or a combination thereof, wherein the weft yarn comprises from more than 0% by weight to about 2.5% by weight aramid, nylon, FR rayon, polybenzimidazole, or oxidized polyacrylonitrile, or a combination, wherein the fabric does not have more than about 5% by weight of aramid, nylon, FR rayon, polybenzimidazole, or oxidized polyacrylonitrile, or a combination thereof.

In one aspect, the weft yarn comprises at least one FR weft yarn comprising FR fibers selected from aramid, nylon, FR rayon, polybenzimidazole, or oxidized polyacrylonitrile, or a combination thereof, wherein the weft yarn comprises from more than 0% by weight to about 4.5% by weight aramid, nylon, FR rayon, polybenzimidazole, or oxidized polyacrylonitrile, or a combination, wherein the fabric does not have more than about 4.5% by weight of aramid, nylon, FR rayon, polybenzimidazole, or oxidized polyacrylonitrile, or a combination thereof. For example, the weft yarn can comprise comprises at least one FR weft yarn comprising FR fibers selected from aramid, nylon, FR rayon, polybenzimidazole, or oxidized polyacrylonitrile, or a combination thereof, wherein the weft yarn comprises from more than 0% by weight to about 3.5% by weight aramid, nylon, FR rayon, polybenzimidazole, or oxidized polyacrylonitrile, or a combination, wherein the fabric does not have more than about 4.5% by weight of aramid, nylon, FR rayon, polybenzimidazole, or oxidized polyacrylonitrile, or a combination thereof. In yet another example, the weft yarn can comprise comprises at least one FR weft yarn comprising FR fibers selected from aramid, nylon, FR rayon, polybenzimidazole, or oxidized polyacrylonitrile, or a combination thereof, wherein the weft yarn comprises from more than 0% by weight to about 2.5% by weight aramid, nylon, FR rayon, polybenzimidazole, or oxidized polyacrylonitrile, or a combination, wherein the fabric does not have more than about 4.5% by weight of aramid, nylon, FR rayon, polybenzimidazole, or oxidized polyacrylonitrile, or a combination thereof.

In one aspect, the weft yarn comprises at least one FR weft yarn comprising FR fibers selected from aramid, nylon, FR rayon, polybenzimidazole, or oxidized polyacrylonitrile, or a combination thereof, wherein the weft yarn comprises from more than 0% by weight to about 25% by weight aramid, nylon, FR rayon, polybenzimidazole, or oxidized polyacrylonitrile, or a combination. For example, the weft yarn can comprise comprises at least one FR weft yarn comprising FR fibers selected from aramid, nylon, FR rayon, polybenzimidazole, or oxidized polyacrylonitrile, or a combination thereof, wherein the weft yarn comprises from more than 0% by weight to about 15% by weight aramid, nylon, FR rayon, polybenzimidazole, or oxidized polyacrylonitrile, or a combination. In yet another example, the weft yarn can comprise comprises at least one FR weft yarn comprising FR fibers selected from aramid, nylon, FR rayon, polybenzimidazole, or oxidized polyacrylonitrile, or a combination thereof, wherein the weft yarn comprises from about 5% by weight to about 15% by weight aramid, nylon, FR rayon, polybenzimidazole, or oxidized polyacrylonitrile, or a combination.

In one aspect, the natural fibers include at least one polymer selected from the group consisting of cellulose, cellulose derivative (such as cotton, viscose, linen, rayon, fire-resistant rayon, lyocell, or a combination thereof), wool, and copolymers thereof, and combinations thereof. For example, the natural fibers can comprise a cellulose derivative, including but not limited to, cotton, viscose, linen, rayon, or a combination thereof. In another example, the natural fibers can comprise cotton. In another example, the natural fibers can consist essentially of or consist of cotton.

In one aspect, the fabric further comprises an elastane filament. The elastane filament can be present in the warp yarns or the weft yarns, or both. For example, the elastane filament can be present in the warp yarns. In another example, the elastane filament can be present in the warp yarns and not in the weft yarns. In yet another example, the elastane filament can be present in the weft yarns. In another example, the elastane filament can be present in the weft yarns and not in the warp yarns.

In one aspect, the fabric can have a concentration of the elastane filament of about 10% or less by weight of the fabric. For example, the fabric can have a concentration of the elastane filament from about 0.25% to about 10% by weight of the fabric. In another example, the fabric can have a concentration of the elastane filament from about 0.25% to about 5% by weight of the fabric. In yet another example, the fabric can have a concentration of the elastane filament from about 0.25% to about 2% by weight of the fabric.

In one aspect, the fabric can have a stretch of about 20% or less in a warp direction. In another aspect, the fabric can have a stretch of about 40% or less in a warp direction.

In one aspect, the fabric can have a stretch of about 20% or less in a weft direction. In another aspect, the fabric can have a stretch of about 40% or less in a weft direction.

In one aspect, the plurality of warp yarns comprises a pattern defined by an arrangement of the at least one natural warp yarn and the at least one FR warp yarn, wherein each FR warp yarn is substantially evenly distributed throughout the plurality of warp yarns. Accordingly, in the plurality of warp yarns the at least one FR warp yarn is substantially evenly distributed throughout a plurality of natural warp yarns. FIG. 1 is a shows a non-limiting example of such a substantial even distribution. In FIG. 1, a FR warp yarn is followed by eleven natural warp yarns before another FR warp yarn is present. This pattern is then repeated throughout the fabric.

In one aspect, the plurality of warp yarns comprises a pattern defined by an arrangement of the at least one natural warp yarn and the at least one FR warp yarn, wherein each FR warp yarn is substantially evenly distributed throughout the plurality of warp yarns, wherein the ratio of the at least one FR warp yarn to the at least one natural warp yarn is from 1:1 to 1:25. As such, the pattern can be alternating one natural warp yarn and one FR warp yarn, when the ratio of the at least one FR warp yarn to the at least one natural warp yarn is from 1:1. In another example, the pattern can be one FR warp yarn followed by 25 natural warp yarns, when the ratio of the at least one FR warp yarn to the at least one natural warp yarn is 1:25.

In one example, the plurality of warp yarns comprises a pattern defined by an arrangement of the at least one natural warp yarn and the at least one FR warp yarn, wherein each FR warp yarn is substantially evenly distributed throughout the plurality of warp yarns, wherein the ratio of the at least one FR warp yarn to the at least one natural warp yarn is from 1:10 to 1:15. In yet another example, the plurality of warp yarns comprises a pattern defined by an arrangement of the at least one natural warp yarn and the at least one FR warp yarn, wherein each FR warp yarn is substantially evenly distributed throughout the plurality of warp yarns, wherein the ratio of the at least one FR warp yarn to the at least one natural warp yarn is 1:1, 1:2, 1:3, 1:4, 1:5, 1:6, 1:7, 1:8, 1:9, 1:10, 1:11, 1:12, 1:13, 1:14, 1:15, 1:16, 1:17, 1:18, 1:19, 1:20, 1:21, 1:22, 1:23, 1:24, or 1:25.

In one aspect, the plurality of warp yarns can comprise a pattern defined by an arrangement of the at least one natural warp yarn and the at least one FR warp yarn, wherein the ratio of the at least one FR warp yarn to the at least one natural warp yarn is from 1:1 to 1:25. For example, the plurality of warp yarns can comprise a pattern defined by an arrangement of the at least one natural warp yarn and the at least one FR warp yarn, wherein the ratio of the at least one FR warp yarn to the at least one natural warp yarn is from 1:10 to 1:15. In another example, the plurality of warp yarns can comprise a pattern defined by an arrangement of the at least one natural warp yarn and the at least one FR warp yarn, wherein the ratio of the at least one FR warp yarn to the at least one natural warp yarn is 1:1, 1:2, 1:3, 1:4, 1:5, 1:6, 1:7, 1:8, 1:9, 1:10, 1:11, 1:12, 1:13, 1:14, 1:15, 1:16, 1:17, 1:18, 1:19, 1:20, 1:21, 1:22, 1:23, 1:24, or 1:25.

In one aspect, the plurality of warp yarns comprises a repeated pattern defined by an arrangement of the at least one natural warp yarn and the at least one FR warp yarn, wherein the repeated pattern is one FR warp yarn followed by 1-25 natural warp yarns. The pattern can comprise a pattern of multiple FR warp yarns being distributed in a repeated pattern throughout the fabric relative to the natural warp yarns. For example, 1, 2, 3, 4, or 5 FR warp yarns can be arranged in a pattern that is repeated pattern throughout the fabric relative to the natural warp yarns. For example, the plurality of warp yarns comprises a repeated pattern defined by an arrangement of the at least one natural warp yarn and the at least one FR warp yarn, wherein the repeated pattern is one FR warp yarn followed by 10-15 natural warp yarns. In another example, the plurality of warp yarns comprises a repeated pattern defined by an arrangement of the at least one natural warp yarn and the at least one FR warp yarn, wherein the repeated pattern is one FR warp yarn followed by 1, 2, 3, 4, 5, 6, 7, 8, 9, 10, 11, 12, 13, 14, 15, 16, 17, 18, 19, 20, 21, 22, 23, 24, or 25 natural warp yarns. For example, the plurality of warp yarns comprises a repeated pattern defined by an arrangement of the at least one natural warp yarn and the at least one FR warp yarn, wherein the repeated pattern is one FR warp yarn followed by 11 natural warp yarns.

Figure 2:
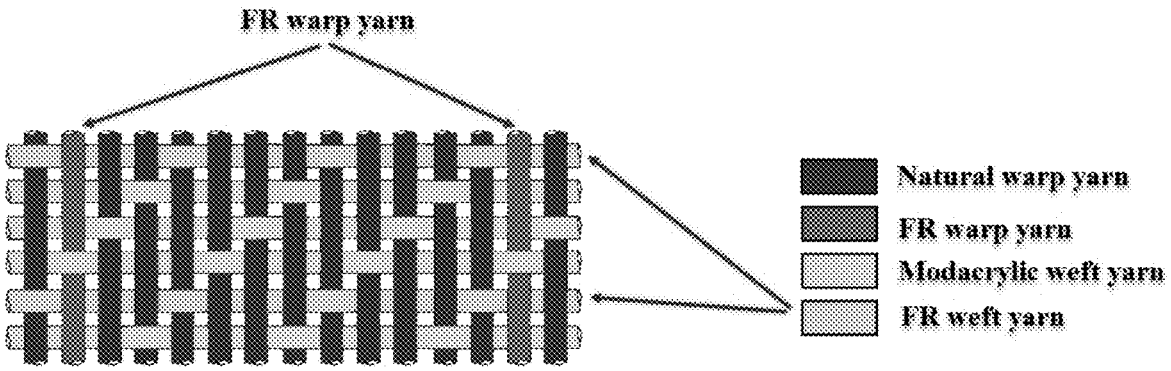
FIG. 2 shows a non-limiting exemplary fabric disclosed herein.

In one aspect, the plurality of weft yarns can comprise a pattern defined by an arrangement of the at least one modacrylic weft yarn and at least one FR weft yarn comprising FR fibers selected from the aramid, nylon, FR rayon, polybenzimidazole, or oxidized polyacrylonitrile, or a combination thereof, wherein each FR weft yarn is substantially evenly distributed throughout the plurality of weft yarns. Accordingly, in the plurality of weft yarns the at least one FR weft yarn is substantially evenly distributed throughout a plurality of modacrylic weft yarn. FIG. 2 is a shows a non-limiting example of such a substantial even distribution. In FIG. 2, a FR weft yarn is followed by three modacrylic weft yarns before another FR weft yarn is present. This pattern is then repeated throughout the fabric. Similar to FIG. 1, FIG. 2 also shows a FR warp yarn followed by eleven natural warp yarns before another FR warp yarn is present. This pattern is then repeated throughout the fabric. As such, a pattern can be defined in both the warp direction and the weft direction.

In one aspect, the plurality of weft yarns can comprise a pattern defined by an arrangement of the at least one modarylic weft yarn and at least one FR weft yarn comprising FR fibers selected from aramid, nylon, FR rayon, polybenzimidazole, or oxidized polyacrylonitrile, or a combination thereof, wherein each FR weft yarn is substantially evenly distributed throughout the plurality of weft yarns, wherein the ratio of the at least one FR weft yarn to the at least one modacrylic weft yarn is from 1:1 to 1:25. For example, the plurality of weft yarns can comprise a pattern defined by an arrangement of the at least one modarylic weft yarn and at least one FR weft yarn comprising FR fibers selected from aramid, nylon, FR rayon, polybenzimidazole, or oxidized polyacrylonitrile, or a combination thereof, wherein each FR weft yarn is substantially evenly distributed throughout the plurality of weft yarns, wherein the ratio of the at least one FR weft yarn to the at least one modacrylic weft yarn is from 1:1 to 1:5. In another example, the plurality of weft yarns can comprise a pattern defined by an arrangement of the at least one modarylic weft yarn and at least one FR weft yarn comprising FR fibers selected from aramid, nylon, FR rayon, polybenzimidazole, or oxidized polyacrylonitrile, or a combination thereof, wherein each FR weft yarn is substantially evenly distributed throughout the plurality of weft yarns, wherein the ratio of the at least one FR weft yarn to the at least one modacrylic weft yarn is 1:1, 1:2, 1:3, 1:4, 1:5, 1:6, 1:7, 1:8, 1:9, 1:10, 1:11, 1:12, 1:13, 1:14, 1:15, 1:16, 1:17, 1:18, 1:19, 1:20, 1:21, 1:22, 1:23, 1:24, or 1:25.

In one aspect, the plurality of weft yarns comprises a pattern defined by an arrangement of the at least one modacrylic weft yarn and at least one FR weft yarn comprising FR fibers selected from aramid, nylon, FR rayon, polybenzimidazole, or oxidized polyacrylonitrile, or a combination thereof, wherein the ratio of the at least one FR weft yarn to the at least one modacrylic weft yarn is from 1:1 to 1:25. For example, the plurality of weft yarns comprises a pattern defined by an arrangement of the at least one modacrylic weft yarn and at least one FR weft yarn comprising FR fibers selected from aramid, nylon, FR rayon, polybenzimidazole, or oxidized polyacrylonitrile, or a combination thereof, wherein the ratio of the at least one FR weft yarn to the at least one modacrylic weft yarn is from 1:1 to 1:5. In another example, the plurality of weft yarns comprises a pattern defined by an arrangement of the at least one modacrylic weft yarn and at least one FR weft yarn comprising FR fibers selected from aramid, nylon, FR rayon, polybenzimidazole, or oxidized polyacrylonitrile, or a combination thereof, wherein the ratio of the at least one FR weft yarn to the at least one modacrylic weft yarn is 1:1, 1:2, 1:3, 1:4, 1:5, 1:6, 1:7, 1:8, 1:9, 1:10, 1:11, 1:12, 1:13, 1:14, 1:15, 1:16, 1:17, 1:18, 1:19, 1:20, 1:21, 1:22, 1:23, 1:24, or 1:25.

In one aspect, the plurality of weft yarns can comprise a repeated pattern defined by an arrangement of the at least one modacrylic weft yarn and at least one FR weft yarn comprising FR fibers selected from the aramid, nylon, FR rayon, polybenzimidazole, or oxidized polyacrylonitrile, or a combination thereof, wherein the repeated pattern of one FR weft yarn followed by 1-25 modacrylic weft yarns. The pattern can comprise a pattern of multiple FR weft yarns being distributed in a repeated pattern throughout the fabric relative to the modacrylic weft yarns. For example, 1, 2, 3, 4, or 5 FR weft yarns can be arranged in a pattern that is repeated pattern throughout the fabric relative to the modacrylic weft yarns. For example, the plurality of weft yarns can comprise a repeated pattern defined by an arrangement of the at least one modacrylic weft yarn and at least one FR weft yarn comprising FR fibers selected from the aramid, nylon, FR rayon, polybenzimidazole, or oxidized polyacrylonitrile, or a combination thereof, wherein the repeated pattern of one FR weft yarn followed by 1-5 modacrylic weft yarns. In another example, the plurality of weft yarns can comprise a repeated pattern defined by an arrangement of the at least one modacrylic weft yarn and at least one FR weft yarn comprising FR fibers selected from the aramid, nylon, FR rayon, polybenzimidazole, or oxidized polyacrylonitrile, or a combination thereof, wherein the repeated pattern of one FR weft yarn followed by 1, 2, 3, 4, 5, 6, 7, 8, 9, 10, 11, 12, 13, 14, 15, 16, 17, 18, 19, 20, 21, 22, 23, 24, or 25 modacrylic weft yarns.

The warp yarns and weft yarns disclosed herein can be single-ply or multi-ply.

In one aspect, the weft yarn count can range from about 6.0/1 Ne to about 20.0/1 Ne. For example, the weft yarn count can from about 8.0/1 Ne to about 15.0/1 Ne.

In one aspect, the warp yarn count can range from about 6.0/1 Ne to about 20.0/1 Ne. For example, the warp yarn count can be from about 8.0/1 Ne to about 15.0/1 Ne.

The fabric disclosed herein can prepared by weaving various yarns. The yarns themselves may be prepared by conventional spinning techniques, including, but not limited to, Open end spinning, Murata jet spinning, ring spinning, SIRO spinning, and the like.

In one aspect, the fabric does not comprise fibers that have been treated with an FR agent.

In one aspect, the fabric is a dyed fabric. For example, the fabric can be an indigo dyed fabric. In the dyed fabric, the warp yarns or the weft yarns or both can be dyed. For example, the at least one natural warp yarn can be dyed in the plurality of warp yarns. For example, the warp yarns are dyed and the weft yarns are undyed. In another example, at least one natural warp yarn can be dyed in the plurality of warp yarns and the weft yarns are undyed. As such, the at least one natural warp yarn can be indigo dyed. In one example, the fabric can be sulfur dyed (for black colors and for other desired colors). For non-traditional colors (i.e., colors other than traditional blue denim), both the warp and weft yarns can may be dyed prior to weaving and/or the woven fabric may be dyed the desired color.

In one aspect, the fabric does comprise more than about 5% by weight of aramid, nylon, FR rayon, polybenzimidazole, or oxidized polyacrylonitrile, or a combination thereof. For example, the fabric does comprise more than about 4.5% by weight of aramid, nylon, FR rayon, polybenzimidazole, or oxidized polyacrylonitrile, or a combination thereof. In another example, the fabric does comprise more than about 4.0% by weight of aramid, nylon, FR rayon, polybenzimidazole, or oxidized polyacrylonitrile, or a combination thereof. In yet another example, the fabric does comprise more than about 3.5% by weight of aramid, nylon, FR rayon, polybenzimidazole, or oxidized polyacrylonitrile, or a combination thereof. In yet another example, the fabric does comprise more than about 3.0% by weight of aramid, nylon, FR rayon, polybenzimidazole, or oxidized polyacrylonitrile, or a combination thereof. In yet another example, the fabric does comprise more than about 2.5% by weight of aramid, nylon, FR rayon, polybenzimidazole, or oxidized polyacrylonitrile, or a combination thereof.

The fabric disclosed herein has a basis weight from about 6 oz/yd$^2$ to about 14 oz/yd$^2$. For example, the fabric can have a basis weight from about 6 oz/yd$^2$ to about 13 oz/yd$^2$. In another example, the fabric can have a basis weight from about 6 oz/yd$^2$ to about 12 oz/yd$^2$. In yet another example, the fabric can have a basis weight from about 6 oz/yd$^2$ to about 11 oz/yd$^2$. In yet another example, the fabric can have a basis weight from about 6 oz/yd$^2$ to about 10 oz/yd$^2$. In yet another example, the fabric can have a basis weight from about 6 oz/yd$^2$ to about 9 oz/yd$^2$. In yet another example, the fabric can have a basis weight from about 8 oz/yd$^2$ to about 12 oz/yd$^2$. In yet another example, the fabric can have a basis weight from about 8 oz/yd$^2$ to about 14 oz/yd$^2$. In yet another example, the fabric can have a basis weight from about 10 oz/yd$^2$ to about 14 oz/yd$^2$.

The fabric disclosed herein can also contain other components and treatments. For example, the fabric can contain anti-microbial and/or anti-odor components, such as, for example, triclosan, silver, and the like. The fabric can also be treated with a stain release agent or water repellant on the outside surface of the fabric to reduce overall absorbency of the warp yarn, thereby further improving moisture management. Suitable stain release agents and water repellants include conventional fluoropolymers.

In one aspect, disclosed herein are articles of manufacturer, such as a garment comprising the fabric disclosed herein. The garments can comprise the woven fabric disclosed herein. As disclosed herein, the garments can be any conventional item that is worn. Since the disclosed fabric exhibit fire resistance, the garments are particularly useful in work clothing, especially denim work clothing, such as a pant or coat/jacket coveralls, overalls, and the like. The fabric can also be formed into a shelter, such as a canopy or tent.

The fabric disclosed herein meets the requirements for flame resistance, as set forth in herein National Fire Protection Association (NFPA) 2112.

The NFPA 2112 standard delineates minimum requirements for the design, construction, evaluation, and certification of flame-resistant garments for use by industrial personnel, with the intent of not contributing to the burn injury of the wearer, providing a degree of protection to the wearer, and reducing the severity of burn injuries resulting from short-duration thermal exposures or accidental exposure to flash fires.

To meet the requirements of NFPA 2112 a test sample has to pass the following tests: 1. Vertical Burn as defined in ASTM D6413, with less than 4" (100 mm) char length initial and after 100 industrial laundries (IL), less than 2 sec after flame: 2 Heat Transfer Performance as defined in ASTM F2700, with spaced 6 cal/cm$^2$ or more/Contact 3 cal/cm$^2$ or more: 3. Heat and Thermal Shrinkage Resistance as defined in NFPA 2112, with less than 10% shrink in any direction, and no melt or drip: 4. Manikin Burn as defined in ASTM F1930, with less than 50% body burn.

In another aspect, the fabric also meets the Standard for Electrical Safety in the Workplace as defined in NFPA 70E.

To meet the requirements of NFPA 70E a test sample has to pass the following tests: 1. Arc Rating as defined in ASTM F1959/1959M, with a category 2 rating: 8.0-24.9 cal/cm$^2$: 2. ASTM F1506 related to the Standard Performance Specification for Flame Resistant and Electric Arc Rated Protective Clothing Worn by Workers Exposed to Flames and Electric Arcs; 3: Vertical Burn as defined in ASTM D6413, with less than 6" (152 mm) char length initial and after 25 IL, less than 2 sec after flame.

Thus, one difference between NFPA 2112 and NFPA 70E is that NFPA 2112 requires a Vertical Burn as defined in ASTM D6413 of less than 4" (100 mm) char length initial and after 100 IL, less than 2 sec after flame, while NFPA 70E requires a Vertical Burn as defined in ASTM D6413 of less than 6" (152 mm) char length initial and after 25 IL, less than 2 sec after flame. As such, it is more difficult for a sample to pass NFPA 2112 and NFPA 70E.

In another aspect, the fabric also provides a minimum of 8.0 cal/cm$^2$ of arc rated protection to the wearer, when tested in accordance with ASTM F1959F/F1959M-06ae1.

Arc Rating: ASTM F 1959/F 1959M-06ae1. This test method measures the arc rating of materials intended for use as flame resistant clothing for workers exposed to electric arcs that would generate heat flux rates from 84 to 120 kW/m$^2$ (2 to 600 cal/cm2 s). This test method measures the arc rating of materials which meet the following requirements: less than 150 mm [6 in.] char length and less than 2 s after flame when tested in accordance with Test Method D6413A.

In one aspect, the fabric also meets the requirements for flame resistance, as set forth in ASTM F1506. ASTM F1506: This is the governing ASTM Standard for Flame Resistant Clothing. The standard has two basic requirements: 1. a sample of fabric must self-extinguish with less than 2 second after flame and less than 6" char length according to ASTM Test Method D6413. This flammability test applies to an initial sample and after 25 wash cycles; and 2. the fabric must be tested for Arc Thermal Performance according to ASTM Test Method F1959.

A garment that meets ASTM F1506 also complies with OSHA 1910.269, NESC, and NFPA 70E.

Heat Transfer Performance (HTP) Test. This test method is performed in accordance with ASTM 2700. The samples are washed for three cycles and do not have any seams or being stitched. Three samples are tested in the spaced configuration and three samples are tested in the contact configuration. To pass the HTP test, the samples must pass both the spaced and the contact test configuration.

Flame Resistance of Fabric (Textiles) (Vertical). This test method determines the response of textiles to a standard ignition source, deriving measurement values for after-flame time, afterglow time, and char length. The vertical flame resistance, as determined by this test method, only relates to a specified flame exposure and application time. This test method maintains the specimen in a static, draft-free, vertical position and does not involve movement except that resulting from the exposure. Test Method D6413 has been adopted from Federal Test Standard No. 191A method 5903.1, which has been used for many years in acceptance testing.

Samples can be cut from fabric to be tested and can be mounted in a frame that was hung vertically from inside the flame chamber. A controlled flame was exposed to the sample for a specified period of time. After-flame time, the length of time the material continued to burn after removal of the burner, and after-glow time, the length of time the material glowed after the flame was extinguished, were both recorded. Finally, the specimen is torn by use of weights and the char length, the distance from the edge of the fabric that was exposed to the flame to the end of the area affected by the flame, can be measured.

Characterization of Test Garments Using PyroMan System: Multiple ensembles were submitted for evaluation. Garments were evaluated for resistance to a simulated flash fire exposure employing procedures similar to ASTM F 1930-00 Standard Test Method for Evaluation of Flame Resistant Clothing for Protection Against Flash Fire Simulations Using an Instrumented Manikin. These tests were performed by the Textile Protection and Comfort Center (T-PACC) at North Carolina State University.

ASTM F1930-99 is a full-scale mannequin test designed to test fabrics in completed garment form in a simulated flash fire. A mannequin, with up to 122 heat sensors spaced around its body, is dressed in the test garment, and then exposed to a flash fire for a pre-determined length of time. Tests are usually conducted at heat energies of 1.8-2 cal/cm$^2$ sec, and for durations of 2.5 to 5.0 seconds for single layer garments. Results are reported in percentage of body burn. For consistency in data and accuracy of comparison, the test method defines a standard garment size and configuration that must be used on each test. Test garments were tested over a 100% cotton T-Shirt and briefs per NFPA 2112 Standard on Flame-Resistant Garments for Protection of Industrial Personnel Against Flash Fire.

Heat and Thermal Shrinkage Resistance test—this test determines the performance of fabrics when exposed to heat in an oven at 500° F. Observations of ignition, melting, dripping, or separation are recorded and reported for each specimen. The percent change in the width and length direction of the specimen is calculated. Results are recorded and reported as the average of three specimens.

The present invention is further defined in the following Examples, in which all parts and percentages are by weight, unless otherwise stated. It should be understood that these examples, while indicating preferred embodiments of the invention, are given by way of illustration only. From the above discussion and these examples, one skilled in the art can ascertain the essential characteristics of this invention, and without departing from the spirit and scope thereof, can make various changes and modifications of the invention to adapt it to various usages and conditions.

EXAMPLES

The following examples are put forth so as to provide those of ordinary skill in the art with a complete disclosure and description of how the articles claimed herein are made and evaluated, and are intended to be purely exemplary and are not intended to limit the disclosure. Efforts have been made to ensure accuracy with respect to numbers (e.g., amounts, temperature, etc.), but some errors and deviations should be accounted for.

Example 1: Testing of Fire Resistant Fabrics

The data presented in Table 1 was performed by UL, which is the only organization licensed to perform certified testing related to fire resistance of fabrics. Fabrics A, B, and C referred to in Table 1 were prepared by conventional methods.

Fabric A serves as a control. Fabric A has a warp yarn of 100 wt % cotton at a count of 8/1 Ne and a weft yarn of 75 wt % modacrylic and 25 wt % cotton at a count of 12/2 Ne. Fabric A does not contain any FR yarn.

Fabric B is an non-limiting example of a fabric disclosed herein. Fabric B has a natural warp yarn of 100 wt % cotton at a count of 8/1 Ne and a FR warp yarn of 90 wt % cotton and 10 wt % para-aramid at a count of 9/1 Ne. Fabric B has a modacrylic weft yarn of 75 wt % modacrylic and 25 wt % cotton at a count of 12/2 and a modacrylic weft yarn of 74 wt % modacrylic, 24 wt % cotton, and 2 wt % spandex at a count of 12/2. The modacrylic yarns are alternated in Fabric B. Fabric B has repeated pattern of the warp yarns that is defined by an arrangement of natural warp yarns and FR warp yarns, wherein the repeated pattern is one FR warp yarn followed by 11 natural warp yarns. FIG. 1 shows the repeated pattern of Fabric B.

Fabric C is an non-limiting example of a fabric disclosed herein. Fabric C has a natural warp yarn of 100 wt % cotton at a count of 10/1 Ne and a FR warp yarn of 90 wt % cotton and 10 wt % para-aramid at a count of 9/1 Ne. Fabric C has a modacrylic weft yarn of 73 wt % modacrylic, 24 wt % cotton, and 3 wt % spandex at a count of 12/1 Ne and a FR weft yarn of 75 wt % modacrylic, 15 wt % cotton, and 10 wt % para-aramid at a count of 10/1 Ne. Fabric C has repeated pattern of the warp yarns that is defined by an arrangement of natural warp yarns and FR warp yarns, wherein the repeated pattern is one FR warp yarn followed by 11 natural warp yarns. Fabric C also has a repeated pattern of weft yarns defined an arrangement of modacrylic weft yarns and FR weft yarns, wherein the repeated pattern is one FR weft yarn followed by one modacrylic weft yarn.

TABLE 1

| Vertical Burn Char Length ASTM D6413 | | | | |
|---|---|---|---|---|
| Fabric | Fabric A- 13.5 oz Denim 68% Cotton/ 32% Modacrylic | Fabric B- 13 oz Denim 66% Cotton/ 32% Modacrylic/ 1% Elastane/ 1% Aramid | Fabric C- 11 oz Denim 68% Cotton/ 29% Modacrylic/ 1% Elastane/ 2% Aramid | Requirement (NFPA 2112) |
| Initial-Warp (mm) | 66 | 81 | 57 | 100 |
| Initial-Weft (mm) | 62 | 64 | 54 | 100 |
| 100 IL-Warp (mm) | 77 | 84 | 45 | 100 |
| 100 IL-Weft (mm) | 112 | 45 | 66 | 100 |

Table 1 shows that Fabric A, which serves as the control sample, does not comply with ASTM D6413 after 100 industrial laundry (IL) cycles, because it has more than 100 mm in the weft direction. As such, Fabric A also does not comply with NFPA 2112.

Table 1 shows that Fabrics B and C, which are non-limiting examples of fabrics disclosed herein, do comply with ASTM D6413 after 100 industrial laundry (IL) cycles, because it they have less than 100 mm in both the warp and the weft directions. Fabrics B and C also complies with the other requirements set forth in NFPA 2112 as shown in Table 2. As such, Fabrics B and C comply with NFPA 2112.

TABLE 2

| Fabric | Fabric B- 13 oz Denim 66% Cotton/ 32% Modacrylic/ 1% Elastane/ 1% Aramid | Fabric C- 11 oz Denim 68% Cotton/ 29% Modacrylic/ 1% Elastane/ 2% Aramid | Requirement |
|---|---|---|---|
| Heat Transfer Performance** Contact Initial/Washed ($cal/cm^2$) ASTM F2700 | 13.5/12.7 | 11.8/11.8 | at least 3.0 $cal/cm^2$ |
| Heat Transfer Performance** Spaced Initial/Washed ($cal/cm^2$) ASTM F2700 | 16.3/16.5 | 14.9/15.0 | at least 6.0 $cal/cm^2$ |
| Heat and Thermal Shrinkage Resistance** Warp Initial/Washed Method described in NFPA 2112 | −1%/−1% no melt or drip | 0%/0% no melt or drip | <10% shrink no melt or drip |

TABLE 2-continued

| Fabric | Fabric B- 13 oz Denim 66% Cotton/ 32% Modacrylic/ 1% Elastane/ 1% Aramid | Fabric C- 11 oz Denim 68% Cotton/ 29% Modacrylic/ 1% Elastane/ 2% Aramid | Requirement |
|---|---|---|---|
| Heat and Thermal Shrinkage Resistance** Weft Initial/Washed Method described in NFPA 2112 | −4%/−4% no melt or drip | 0%/0% no melt or drip | <10% shrink no melt or drip |
| Manikin Burn (% Body Burn)*** ASTM F1930 | 6.56% | 8.47% | <50% |

Fabrics B and C also comply with the requirements set forth in NFPA 70E, as shown in Table 3. Fabric A also complies with the requirements set forth in NFPA 70E, as shown in Table 3.

TABLE 3

| Fabric | Fabric A- 13.5 oz Denim 68% Cotton/ 32% Modacrylic | Fabric B- 13 oz Denim 66% Cotton/ 32% Modacrylic/ 1% Elastane/ 1% Aramid | Fabric C- 11 oz Denim 68% Cotton/ 29% Modacrylic/ 1% Elastane/ 2% Aramid | Requirement (NFPA 70E) |
|---|---|---|---|---|
| Arc Rating (cal/cm$^2$) ASTM F1959 Vertical Burn Char Length ASTM D6413 | 15 | 16 | 12 | Level 2: 8.0-24.0 |
| Initial-Warp (mm) | 66 | 81 | 57 | 152 |
| Initial-Weft (mm) | 62 | 64 | 54 | 152 |
| 100 IL-Warp (mm) | 77 | 84 | 45 | 152 |
| 100 IL-Weft (mm) | 112 | 45 | 66 | 152 |

Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

What is claimed is:

1. A fabric comprising:

a) a plurality of warp yarns comprising from about more than 95% to about 99.75% by weight of at least one natural fiber and from about 0.25% to less than about 5% by weight of aramid, nylon, FR rayon, polybenzimidazole, or oxidized polyacrylonitrile, or a combination thereof; wherein the plurality of warp yarns comprises:

i) at least one natural warp yarn consisting essentially of natural fibers; and ii) at least one FR warp yarn comprising FR fibers selected from aramid, nylon, FR rayon, polybenzimidazole, or oxidized polyacrylonitrile, or a combination thereof;

b) a plurality of weft yarns comprising at least one modacrylic weft yarn comprising from about 0% to 35% by weight of natural fiber and 100% to 65% by weight of modacrylic fibers;

wherein the fabric meets the requirements for flame resistance, as set forth in National Fire Protection Association 2112; and wherein the fabric has a basis weight from about 6 oz/yd$^2$ to about 14 oz/yd$^2$.

2. The fabric of claim 1, wherein the fabric is in the form of a garment.

3. The fabric of claim 1, wherein the fabric meets the requirements for flame resistance, as set forth in ASTM F1506 and/or provides a minimum of 8.0 cal/cm2 of arc rated protection to the wearer, when tested in accordance with ASTM F1959F/F1959M-06ae1; Standard on Flame-Resistant Garments for Industrial Personnel Against Flash Fire and/or or National Fire Protection Association 70E.

4. The fabric of claim 1, wherein the fabric is denim.

5. The fabric of claim 1, wherein the FR warp yarn comprises a mixture of natural fibers and the FR fibers selected from aramid, nylon, FR rayon, polybenzimidazole, or oxidized polyacrylonitrile, or a combination thereof.

6. The fabric of claim 1, wherein FR warp yarn comprises from about 25% by weight to about 95% by weight of the natural fibers and from about 75% by weight to about 5% by weight of the FR fibers selected from aramid, nylon, FR rayon, polybenzimidazole, or oxidized polyacrylonitrile, or a combination thereof.

7. The fabric of claim 1, wherein the weft yarn comprises about 20% to 30% by weight of natural fiber and 80% to 70% by weight of modacrylic fibers.

8. The fabric of claim 1, wherein FR warp yarn comprising FR fibers of aramid.

9. The fabric of claim 1, wherein the plurality of warp yarns comprises from about more than 95.5% to about 99.75% by weight of at least one natural fiber and from about 0.25% to less than about 4.5% by weight of aramid, nylon, FR rayon, polybenzimidazole, or oxidized polyacrylonitrile, or a combination thereof.

10. The fabric of claim 1, wherein the fabric further comprises an elastane filament.

11. The fabric of claim 1, wherein the fabric is a dyed fabric.

12. The fabric of claim 1, wherein the weft yarn comprises at least one FR weft yarn comprising FR fibers selected from aramid, nylon, FR rayon, polybenzimidazole, or oxidized polyacrylonitrile, or a combination thereof, wherein the weft yarn comprises from more than 0% by weight to about 4.5% by weight aramid, nylon, FR rayon, polybenzimidazole, or oxidized polyacrylonitrile, or a combination, wherein the fabric does not have more than about 5% by weight of aramid, nylon, FR rayon, polybenzimidazole, or oxidized polyacrylonitrile, or a combination thereof.

13. The fabric of claim 1, wherein the plurality of warp yarns comprises a pattern defined by an arrangement of the at least one natural warp yarn and the at least one FR warp yarn, wherein each FR warp yarn is substantially evenly distributed throughout the plurality of warp yarns, wherein the ratio of the at least one FR warp yarn to the at least one natural warp yarn is from 1:1 to 1:25.

14. The fabric of claim 1, wherein the plurality of warp yarns comprises a pattern defined by an arrangement of the at least one natural warp yarn and the at least one FR warp yarn, wherein the ratio of the at least one FR warp yarn to the at least one natural warp yarn is from 1:1 to 1:25.

15. The fabric of claim 1, wherein the plurality of warp yarns comprises a repeated pattern defined by an arrangement of the at least one natural warp yarn and the at least one FR warp yarn, wherein the repeated pattern is one FR warp yarn followed by 1-25 natural warp yarns.

16. The fabric of claim 1, wherein the plurality of weft yarns comprises a pattern defined by an arrangement of the at least one modacrylic weft yarn and at least one FR weft yarn comprising FR fibers selected from aramid, nylon, FR rayon, polybenzimidazole, or oxidized polyacrylonitrile, or a combination thereof, wherein each FR weft yarn is substantially evenly distributed throughout the plurality of weft yarns.

17. A fabric comprising:

a) a plurality of warp yarns comprising:

i) at least one natural warp yarn consisting essentially of natural fibers; and ii) at least one FR warp yarn comprising FR fibers selected from aramid, nylon, FR rayon, polybenzimidazole, or oxidized polyacrylonitrile, or a combination thereof;

wherein the plurality of warp yarns comprises a pattern defined by an arrangement of the at least one natural warp yarn and the at least one FR warp yarn, wherein each FR warp yarn is substantially evenly distributed throughout the plurality of warp yarns, and b) a plurality of weft yarns comprising at least one modacrylic weft yarn comprising from about 0% to 35% by weight of natural fiber and 100% to 65% by weight of modacrylic fibers;

wherein the fabric meets the requirements for flame resistance, as set forth in National Fire Protection Association 2112; and wherein the fabric has a basis weight from about 6 oz/yd$^2$ to about 14 oz/yd$^2$.

18. The fabric of claim 17, wherein the plurality of warp yarns comprises a pattern defined by an arrangement of the at least one natural warp yarn and the at least one FR warp yarn, wherein each FR warp yarn is substantially evenly distributed throughout the plurality of warp yarns, wherein the ratio of the at least one FR warp yarn to the at least one natural warp yarn is from 1:5 to 1:25.

19. The fabric of claim 17, wherein the plurality of warp yarns comprises a pattern defined by an arrangement of the at least one natural warp yarn and the at least one FR warp yarn, wherein the ratio of the at least one FR warp yarn to the at least one natural warp yarn is from 1:5 to 1:25.

20. The fabric of claim 17, wherein the plurality of warp yarns comprises a repeated pattern defined by an arrangement of the at least one natural warp yarn and the at least one FR warp yarn, wherein the repeated pattern is one FR warp yarn followed by 1-25 natural warp yarns.

* * * * *